US010731412B2

(12) United States Patent
Roberts et al.

(10) Patent No.: US 10,731,412 B2
(45) Date of Patent: Aug. 4, 2020

(54) UPPER GUIDE TRACK AND ASSEMBLY FOR A RETRACTABLE SCREEN

(71) Applicant: INFINITY RETRACTABLE SCREENS PTY LTD, Currumbin Waters (AU)

(72) Inventors: Anthony Gerard Roberts, Currumbin Waters (AU); Aaron Rodd, Currumbin Waters (AU)

(73) Assignee: INFINITY RETRACTABLE SCREENS PTY LTD (AU)

( * ) Notice: Subject to any disclaimer, the term of this patent is extended or adjusted under 35 U.S.C. 154(b) by 96 days.

(21) Appl. No.: 15/827,609

(22) Filed: Nov. 30, 2017

(65) Prior Publication Data

US 2018/0148974 A1 May 31, 2018

(30) Foreign Application Priority Data

Nov. 30, 2016 (AU) ..... 2016904917
Nov. 30, 2016 (AU) ..... 2016904918
Nov. 30, 2016 (AU) ..... 2016904919

(51) Int. Cl.
*E06B 9/58* (2006.01)
*E05D 15/06* (2006.01)
(Continued)

(52) U.S. Cl.
CPC ..... *E06B 9/58* (2013.01); *E05D 15/0621* (2013.01); *E05D 15/0691* (2013.01);
(Continued)

(58) Field of Classification Search
CPC ..... E06B 9/58; E06B 1/70; E06B 9/54; E06B 2009/587; E06B 2009/543; E06B 9/581;
(Continued)

(56) References Cited

U.S. PATENT DOCUMENTS 8,291,960 B2 10/2012 Bowman
2004/0154753 A1 8/2004 Tagtow et al.
(Continued)

FOREIGN PATENT DOCUMENTS

AU 2010241510 A1 6/2011
AU 2014203018 A1 12/2015
(Continued)

OTHER PUBLICATIONS

International Type Search Report for Australian Patent Application 2016904917 dated Oct. 30, 2017.

*Primary Examiner* — Justin V Lewis
(74) *Attorney, Agent, or Firm* — Lerner, David, Littenberg, Krumholz & Mentlik, LLP

(57) ABSTRACT

An upper guide track assembly for a retractable screen is described. The assembly comprises a U shaped guide channel, a track attachment member for attaching the assembly to a support, a track outer member connectable to the attachment member and a screen retaining member within the guide channel. The retaining member receives and retains an upper edge of a screen. The retaining member has two resilient wings extending from either side of the body. Each wing is biased towards a position in which the distal end of each wing is away from the body. The wings are moveable against the bias to a retracted position. When the retaining member is retained in the guide channel, each wing is held in the retracted position against the bias. This allows an upper edge of a screen retained by the screen retaining member to be biased in the vertical direction.

18 Claims, 10 Drawing Sheets

(51) Int. Cl.

| | |
|---|---|
| ***E06B 3/46*** | (2006.01) |
| ***E06B 9/54*** | (2006.01) |
| ***E05D 15/26*** | (2006.01) |
| ***E06B 1/70*** | (2006.01) |

(52) U.S. Cl.
CPC ..... *E05D 15/26* (2013.01); *E06B 1/70* (2013.01); *E06B 3/4636* (2013.01); *E06B 9/54* (2013.01); *E05Y 2900/136* (2013.01); *E06B 9/581* (2013.01); *E06B 2009/543* (2013.01); *E06B 2009/587* (2013.01)

(58) Field of Classification Search
CPC ... E06B 3/4636; E05D 15/26; E05D 15/0621; E05D 15/0691; E05Y 2900/136
USPC ..... 160/84.01, 87, 95, 123, 196.1, 197, 201, 160/330, 900
See application file for complete search history.

(56) References Cited

U.S. PATENT DOCUMENTS

| | | | | |
|---|---|---|---|---|
| 2006/0054287 | A1* | 3/2006 | Dickinson, III ..... | E06B 9/54 160/271 |
| 2007/0062122 | A1 | 3/2007 | Polus | |
| 2011/0272104 | A1 | 11/2011 | Dimitrakoudis | |
| 2012/0005975 | A1 | 1/2012 | Kim | |
| 2015/0345215 | A1 | 12/2015 | Roberts | |
| 2019/0249433 | A1 | 8/2019 | Guest et al. | |

FOREIGN PATENT DOCUMENTS

| | | | |
|---|---|---|---|
| AU | 2014268200 | A1 | 6/2016 |
| EP | 3075932 | A1 | 10/2016 |
| GB | 2499840 | A | 9/2013 |
| WO | 2012050518 | A1 | 4/2012 |

* cited by examiner

UPPER GUIDE TRACK AND ASSEMBLY FOR A RETRACTABLE SCREEN

CROSS REFERENCE TO RELATED APPLICATIONS

This application claims priority from Australian Provisional Patent Application No. 2016904917 filed 30 Nov. 2016, Australian Provisional Patent Application No. 2016904918 filed 30 Nov. 2016, and Australian Provisional Patent Application No. 2016904919 filed 30 Nov. 2016, the entire disclosures of which are incorporated herein by reference.

BACKGROUND OF THE INVENTION

The present disclosure relates to an upper guide track assembly for a retractable screen of the type having a flexible screen material that can be drawn off a roller within a housing and across an architectural opening. The disclosure also relates to a method of assembly of the guide track and a retractable screen including the upper guide track.

Retractable screens that can be opened have found appeal with users due to their versatility in being able to be rolled away when not in use. This enables a wide and uninterrupted view when rolled away.

Retractable screens can be mounted across any suitable architectural opening such as windows, doors, and between supports in outdoor areas such as pergolas, gazebos and the like. Retractable screens are often insect screens. However, other types of screens such as solar screens, transparent vinyl screens or the like may also be retractable. The present disclosure will be described with particular reference to an insect screen mesh. However, it will be appreciated that the disclosure may relate to other types of flexible screen material and no limitation is intended thereby.

Retractable screens in general have a roller located within a housing, upon which the screen is rolled onto as the screen is closed and the screen is unrolled from when the screen is opened. The roller is usually biased towards the closed or rolled position. The housing is typically fixed in place at the top of a vertically opening screen or at the side of a horizontally opening screen. The screen extends between a housing and a moveable handle post or drawbar that is moveable between and open position towards the housing and a closed position away from the housing. Upper and lower, right or left guide tracks (for horizontally and vertically opening windows) are operatively engaged with the respective ends of the moveable handle post to guide movement of the post between open and closed positions.

Alternatively, the housing may be located within the moveable handle post, although this is not as preferred for larger screens.

Horizontally opening screens have some challenges. For example, customers are demanding horizontally opening screens of increasing width to extend across open areas that are significantly wider than a standard doorway such as bi-fold doors and French doors. With increased width comes increased size and weight. The design of the roller and guides must accommodate the increased weight. The upper guide track, in particular, must both guide and bear the weight of the screen. The arrangements and methods of mounting the upper guide track to a support must also be able to bear the weight.

This is different to vertically opening screens where the roller is at the top and the guide tracks simply guide the edges of the screen and do not support any weight.

For horizontally opening screens, it is desirable that the edges of the screen are securely held in place and for the screens to have a taut and neat appearance across the face of the screen. Horizontally opening screens are tensioned between the horizontal guides.

With horizontally opening screens, the top guide track is often installed by fixing an attachment member of the upper guide track assembly to the door lintel. When the lintel sags, the upper guide track assembly that is fixed to the lintel will sag. When this occurs, there is a loss of tension in the screen.

By comparison, it will be appreciated that with a vertically opening screen where tension is applied horizontally, any lintel sag will not affect tension in the screen.

Definition

In the present specification and claims the term "comprising" shall be understood to have a broad meaning similar to the term "including" and will be understood to imply the inclusion of a stated integer or step or group of integers or steps but not the exclusion of any other integer or step or group of integers or steps. This definition also applies to variations on the term "comprising" such as "comprise" and "comprises".

SUMMARY

The present disclosure is therefore directed towards providing a guide track assembly for horizontally opening retractable screens that may in some embodiments resist a loss of tension or otherwise at least partially compensate for a sag in a door lintel to which the upper guide track assembly is fixed.

According to one aspect of the disclosure, there is provided an upper guide track assembly for a horizontally opening retractable screen that in use is attached to a support and has an inner side facing towards the support and an outer side facing outwards away from the support; the upper guide track assembly comprising;

- a substantially U shaped guide channel having an inner side wall, an outer second side wall and an upper wall;
- an elongate track attachment member for attaching the upper guide track assembly to the support, the elongate attachment member having a wall section defining the inner side wall of the guide channel;
- an elongate track outer member connectable to the attachment member having a wall section defining the outer side wall of the guide channel; and
- an elongate screen retaining member within the guide channel, wherein the elongate screen retaining member comprises;
- a body having a lower face with a longitudinal channel for receiving and retaining an upper edge of a retractable screen;
- a first substantially resilient wing and a second substantially resilient wing extending from respective first and second sides of the body and each first and second wing is biased towards an open position in which the distal end of each wing is away from the body and is moveable against the bias to a retracted position in which each distal end of each wing is towards the body; and
- when the screen retaining member is retained in the guide channel, each first and second wing is held in the closed position against the bias of the wing by contact with respective first and second side walls of the guide channel, such that an upper edge of a retractable screen retained by the screen retaining member is biased in the vertical direction and the body of the screen retaining member is spaced from the upper wall of the guide channel.

In the present description and claims, the term "inner" refers to that side of the assembly, or a component that faces inwardly relative to the support. The term "outer" refers to that side of the assembly or a component thereof that in use faces outwardly relative to the support. The terms "upper" and "lower" refer to the respective orientations when the guide track assembly is mounted to the support.

The elongate attachment member is suitably an aluminium extrusion. The attachment member is attachable to a support which is suitably a door lintel. Attachment may be by any suitable means and is suitably a screw.

The attachment member has a wall section that in use defines an inner side wall of the guide channel. Suitably the attachment member includes an upper attachment section that is configured to receive a fastener to fasten the guide track assembly to a support and a lower wall section that defines the inner side wall of the guide channel.

In one embodiment, the upper attachment section includes an inner channel of rectangular cross section having a wall that is contiguous with the lower wall section and which in use receives a fastener for fastening the attachment member to a support.

In one embodiment the attachment member has a lower horizontal wall section that in use defines the upper wall of the guide channel.

The guide track assembly also includes an elongate track outer member that is connectable to the attachment member. The elongate track outer member is suitably an aluminium extrusion. The elongate track outer member has a wall section that forms the second wall of the guide channel.

Suitably the attachment member and outer member are connectable by a fastener such as a screw.

In the embodiment where the attachment member includes an upper attachment section, the upper attachment section may include a channel of U shaped cross section having an opening facing towards the outer side of the guide track assembly. The outer track member may also include a channel of U shaped cross section, having an opening that is also outwardly facing towards the outer side of the guide track assembly. The respective U shaped channels are complementary in shape such that in use the U shaped section of the attachment member can at least partially receive the U shaped channel of the outer track member. This arrangement allows the respective attachment and outer track members to be positioned relative to each other in an easy and aligned manner during assembly of the guide track assembly.

In this arrangement, the respective end walls of each U shaped section abut. The abutting walls may be fixed together by a fastener such as a screw.

Suitably the guide track assembly further includes a cover member that can cover the open end of the U shaped section of the track outer member so as to provide a neat appearance to the outer side of the guide track assembly that is use faces outwardly away from the support.

The guide track assembly includes a screen retaining member having a body and two substantially resilient wings extending therefrom.

In one aspect, the screen retaining member body is substantially rigid. By substantially rigid, it is meant that the body may tolerate some degree of flex but essentially retains its shape under stress. The substantially rigid body is suitably a substantially rigid thermoplastic such as poly (vinyl chloride), (PVC).

Two substantially resilient wings extending from the body. By substantially resilient is meant that the wings can resist being deformed towards the body, or in other words are biased such that distal ends of the wings are away from the body. A suitable material is a thermoplastic elastomer such as polyurethane.

In one aspect the screen retaining member is formed by co-extrusion of an elastomeric material whereby the body is a substantially rigid thermoplastic and the wings are a resilient thermoplastic elastomer. Suitable materials and co-extrusion methods are known in the art.

In an alternative aspect, the body and wings may be formed separately and joined together. This may provide a greater control of the respective physical and chemical properties of the body and wings, as it allows for the parts to be formed from materials that would not otherwise be compatible for co-extrusion.

In one aspect the body may be formed by extrusion of a metallic material such as aluminium. Such a construction may be more rigid than a rigid plastics material.

The wings may be extruded separately from a resilient plastics material and the body and wings fixed together. Fixing of the two parts together may be by any suitable means.

In one aspect, the wings have a longitudinal recess or projection along the proximal end thereof and the body has the other of a longitudinal projection or recess for sliding engagement between the body and wings.

In the aspect where the wings have a longitudinal projection at the proximal end, in order to facilitate and resist detachment, the projections may be formed from a more rigid material than the main part of the wings. Suitably the wings may be co-extruded with the projections extruded from a rigid thermoplastic such as a rigid PVC and the main portion of the wings extruded from a thermoplastic elastomer.

In the aspect where the screen retaining member body is an aluminium extrusion, the screen retaining member suitably further comprises a liner within the longitudinal channel upon which an upper thickened edge of the screen may run. This can facilitate a smooth running of the screen. A suitable material is a rigid thermoplastic such as PVC.

Also disclosed herein is a screen retaining member for an upper guide track of a horizontally opening retractable screen, comprising a body having a longitudinal channel for receiving and retaining an upper edge of a retractable screen; a first substantially resilient wing and a second substantially resilient wing extending from respective first and second sides of the body and each first and second wing is biased towards an open position in which the distal end of each wing is away from the body and is moveable against the bias to a closed position in which each distal end of each wing is towards the body.

The wings are normally biased towards an open position, but when in the guide channel, each wing is held in the closed position in which the distal ends of the wings are towards the body, by contact of the distal ends of the wings with the walls of the guide channel. This biases the screen retaining member in the vertical direction away from the centre of the screen.

The screen retaining member is spaced from the upper wall of the guide channel such that the screen retaining member is effectively in a "floating" position within the guide member. If the support upon which the guide track assembly, sags or otherwise moves, the guide track assembly that is fixed to the support will likewise move. However, this sag may be compensated by the wings biasing the screen retaining member in the vertical direction such that the position of the screen retaining member does not change, thereby minimising or reducing any reduction in tension of the screen.

The screen retaining member has a channel for retaining an upper edge of a retractable screen. The edge of the screen is suitably a thickened edge. A particularly suitable screen has a zipper edge. Zipper edges are can be securely retained within retaining channels.

The present disclosure also relates to a method of installing the guide track assembly. The elongate track attachment member and elongate track outer member are initially loosely connected together. As respective wall sections of the track attachment and track outer members define the walls of the guide channel, when the respective members are in the loosely connected position, the opening of the U shaped guide channel is wider than when in the in use position.

One suitable method for moving the respective members towards each other is by use of a threaded fastener.

Suitably, the width of the guide channel in the loosely connected position is wider than the body of the screen retaining member, but not wider than the full width of the body and wings together, when the wings are in the closed position. This allows the screen retaining member to be inserted into the channel relatively easily without the installer and/or assembler having to press upwards against the full bias of the wings.

Suitably, the free ends of each wall of the guide channel have an inwardly facing rib that provides a stop for the distal ends of the wings to hold the screen retaining member within the guide channel.

When the screen retaining member has been inserted into the guide channel, the loose connection between the track attachment member and the outer track member is tightened so as to draw the side walls of the guide channel towards each other, thereby drawing the wings towards each other to the closed position. One suitable method for moving the respective members towards each other is by use of threaded fasteners.

According to a further aspect, there is disclosed a method of assembling the disclosed guide track assembly comprising loosely connecting the elongate track attachment member and the elongate track outer member so as to form the guide channel, wherein the first side wall and the second side wall of the guide channel are spaced apart such that the width of the opening of the guide channel is wider than the width of the body of the screen retaining member but less than the distance between the distal ends of the wings when in the open position; such that the distal end of each wing bears against a respective guide channel side wall and tightening the connection between the upper elongate track attachment member and the elongate track attachment member so as to draw the guide channel side walls together, thereby moving the wings of the screen retaining member to the closed position.

The assembly may be conducted before or after the elongate wall member is attached to a support, suitably before the assembly is attached to the support.

Also disclosed herein is a vertically opening screen having an upper guide track and a lower guide track and a roller assembly, wherein the upper guide track is an upper guide track assembly as disclosed herein.

The upper guide track may be any one or more of the guide tracks as disclosed in any of the preceding aspects of the disclosure.

Suitably the vertically opening screen comprises a drawbar that is operatively engaged with the upper guide track for movement between open and closed positions.

DETAILED DESCRIPTION OF THE FIGURES

Figure 1:
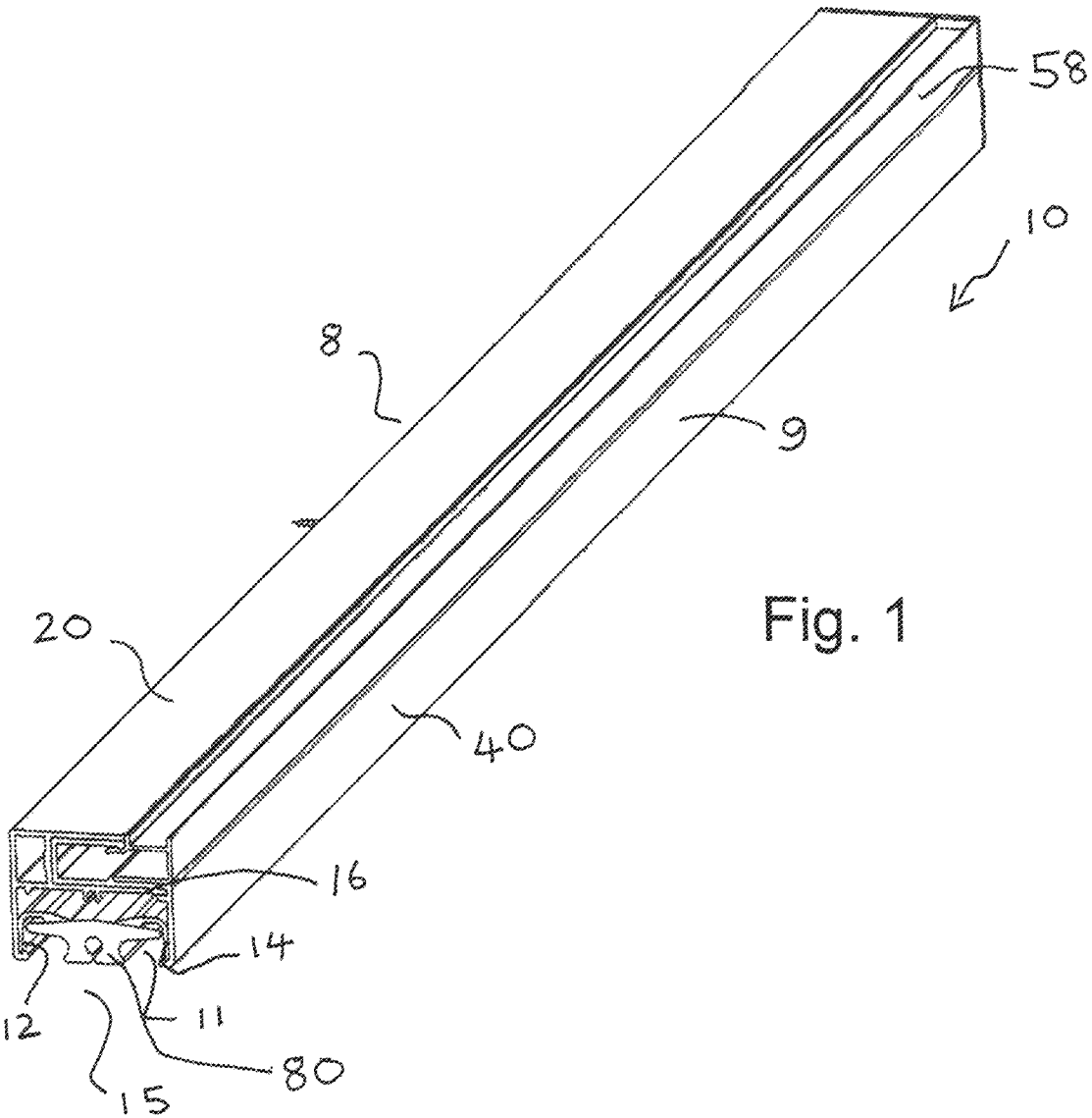
FIG. 1 is a perspective view of a one aspect of an upper guide track assembly as disclosed herein.

FIGS. 1 to 4 show a guide track assembly 10 in accordance with the disclosure. The guide track assembly 10 is mounted to a horizontal support member such as a door lintel. The guide track assembly 10 has an inner side wall 8 that when mounted is towards the support and an outer side wall 9, that when mounted faces outwardly away from the support.

The guide track assembly 10 has a U shaped guide channel 11 that has a first inner wall 12 and a second outer wall 14, an upper wall 16 and an opening 15 is formed between walls 12 and 14.

Figures 3A, 3B, 3C:
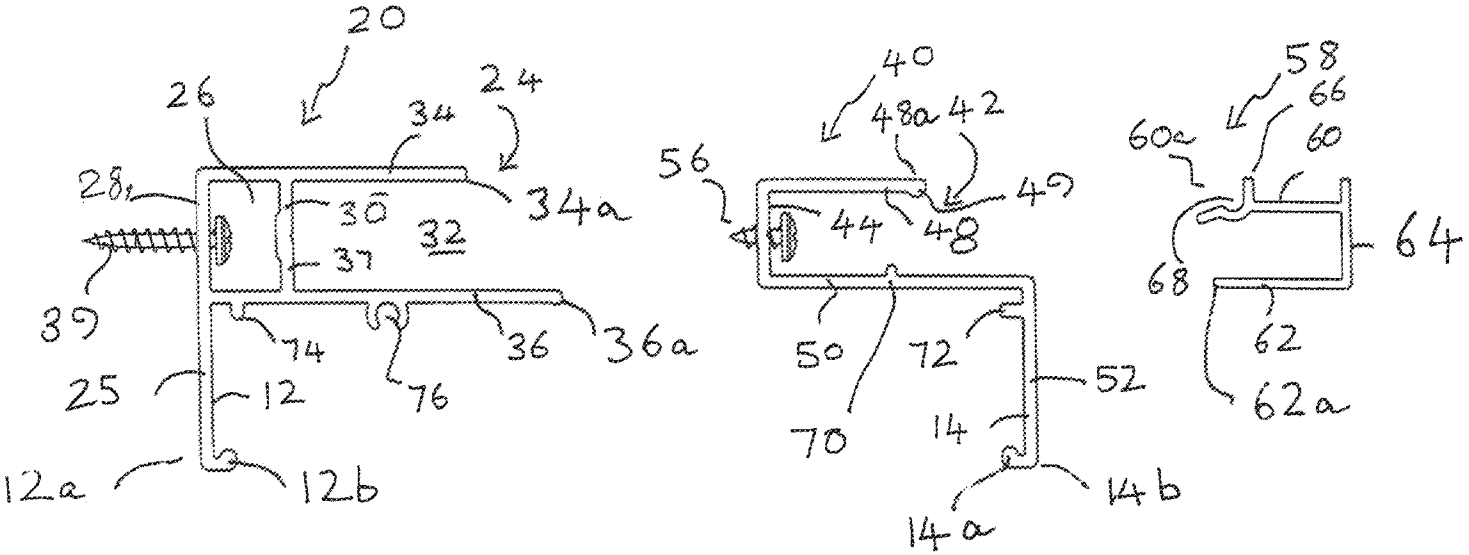
FIGS. 3*a*, 3*b* and 3*c* show cross sectional views of the components of the guide track assembly as shown in FIG. 1.

The guide track assembly 10 includes an elongate track attachment member 20 for attaching the guide track assembly 10 to a support such as a door lintel. The cross section of the guide track assembly 20 is shown in FIG. 3*a*. The track attachment member 20 has an upper section 24 and a lower wall member 25. The lower wall member 25 forms the first inner wall 12 of the guide channel 11.

The upper section 24 of the track attachment member 20 has at attachment portion 26 that is rectangular in cross section with an inner side wall 28 and outer 30 side wall. The upper section 24 also has a section of U shaped cross section 32 in which the open end therefore faces outwardly. The U shaped section 32 has an upper horizontal wall 34, a lower horizontal wall 36, and a rear wall 37 that is common with the outer side wall 30 of the attachment portion 26.

In use the track attachment member 20 is secured to a support such as a door lintel by screws 39 that pass through inner side wall 28.

The guide track assembly 10 also includes an elongate track outer member 40 that engages and is fixed to the attachment member 20, the cross section of which is shown in FIG. 3*b*. The track outer member 40 has an upper section 42 that is U shaped in cross section, the open end of the U being outwardly facing. The U shaped section 42 has a rear wall 44, an upper wall 48 and a base 50. The free end 48*a* of the upper wall 48 of the attachment member 40 terminates in a thickened edge 49.

The track outer member 40 also includes a lower outer wall 52 that is contiguous with and depends from the open end of the base 50. This lower outer wall 52 defines the outer wall 14 of the guide channel 11.

The upper section 42 of the track outer member 40 is complementary in shape to the U shaped section 32 of the elongate track attachment member 20 such that the upper section 42 can be received within section 32 during assembly. During installation of the assembly 10, the two U shaped sections 32, 42 are connected by a screw 56 as shown in FIG. 3. Installation and assembly will be described further below.

Figure 4:
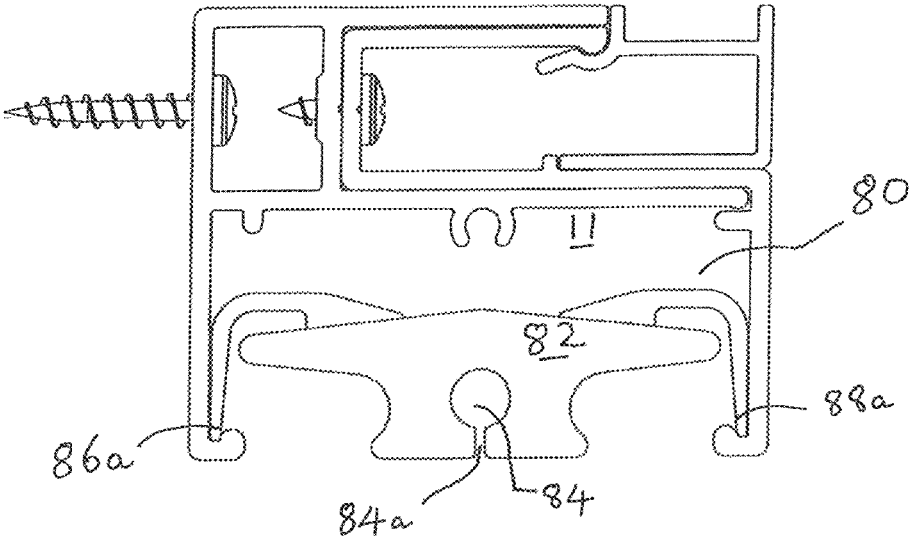
FIG. 4 is a cross section of the guide track assembly as shown in FIG. 1.

FIG. 4 also shows that when the upper section 42 of the track outer member 40 is received within the upper section 24 of the attachment member 20, the free ends 34*a*, 48*a* of the respective upper walls are co-terminus.

The guide track assembly 10 further includes an elongate cover or filler 58 that closes off the open end of the U shaped upper section 42 of the track outer member 40. The cross section is shown in FIG. 3*c*. The track cover 58 is substantially U shaped in cross section with the open end facing inwardly when the guide track assembly 10 is assembled. The track cover 58 has an upper wall 60, a lower wall 62 with a connecting web 64. The track cover 58 is configured relative to the configuration of the track outer member 40 such that it can be received thereby as is clearly shown in FIG. 3.

The free end 60*a* of the upper side wall 60 of the filler 58 has an upstanding rib 66 and a concavity 68. The concavity 68 is complementary to the thickened edge 49 of the upper wall 48 of the track outer member 40 so as to facilitate a snap fit between the track filler 58 and track outer member 40 for ease of assembly. The lower wall 50 of the track outer member 40 has an upstanding rib 70 that acts as a stop for the free end 62*a* of the lower wall 62 of the track filler 58.

FIG. 3*c* and FIG. 4 also show that the lower wall 52 of the track outer member 40 has an inwardly facing rib 72 in the upper part thereof. This rib 72 defines a channel between the rib 72 and the base 50 that snugly receives the free end 36*a* of the lower wall 36 of the track attachment member 20.

The lower wall 36 of the track attachment member 20 also has a downwardly projecting rib 74 that is located towards the inner end of the lower wall 36. The lower wall 36 also has a centrally located curved projection defining a downward facing longitudinal channel 76. The distance d between the projection 76 and rib 74 is the same as the distance d between projection 76 and the free end of rib 72.

These additional features assist with installation of the guide track assembly 10 as will be discussed below.

Figure 5:
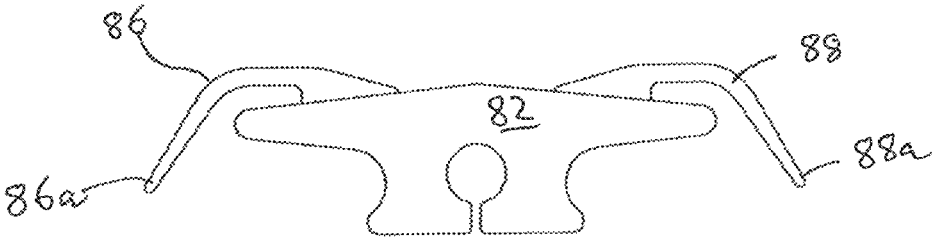
FIG. 5 is a cross section of the screen retaining member of the guide track assembly as shown in FIG. 1 in its extruded open position.

The guide track assembly 10 further includes an elongate screen retaining member 80 located within guide channel 11. With reference to FIGS. 4 and 5, the screen retaining member 80 has a substantially rigid body 82 having a longitudinal channel 84 having a narrow entry channel 84*a*. The channel 84 is configured for receiving and retaining a thickened edge of a screen.

The screen retaining member 80 includes a first and second substantially resilient wings 86, 88 extending therefrom. The screen retaining member 80 is suitably formed from a rubber material that has been coextruded according to known co-extrusion methods.

Each wing 86, 88 is biased towards an open position in which the distal end 86*a*, 88*a* of each wing 86, 88 is away from the body as shown in FIG. 5. FIG. 4 shows that when the screen retaining member is within the guide track 11, each wing 86, 88 is held against the bias in the closed position by the walls 12, 14 of the guide channel 11. The free end 12*a*, 14*a*, of each wall 12, 14 of the guide channel 11 has a return section 12*b*, 14*b* that defines a channel that receives the respective distal end 86*a*, 88*b* of each wing 86, 88. This prevents the screen retaining member from being pulled out of the guide channel 11 by the weight of the screen material.

It may be appreciated that the screen retaining member is in a "floating position" within the guide channel 11 as it is able to move towards the upper wall 16 of the guide channel.

Figure 6:
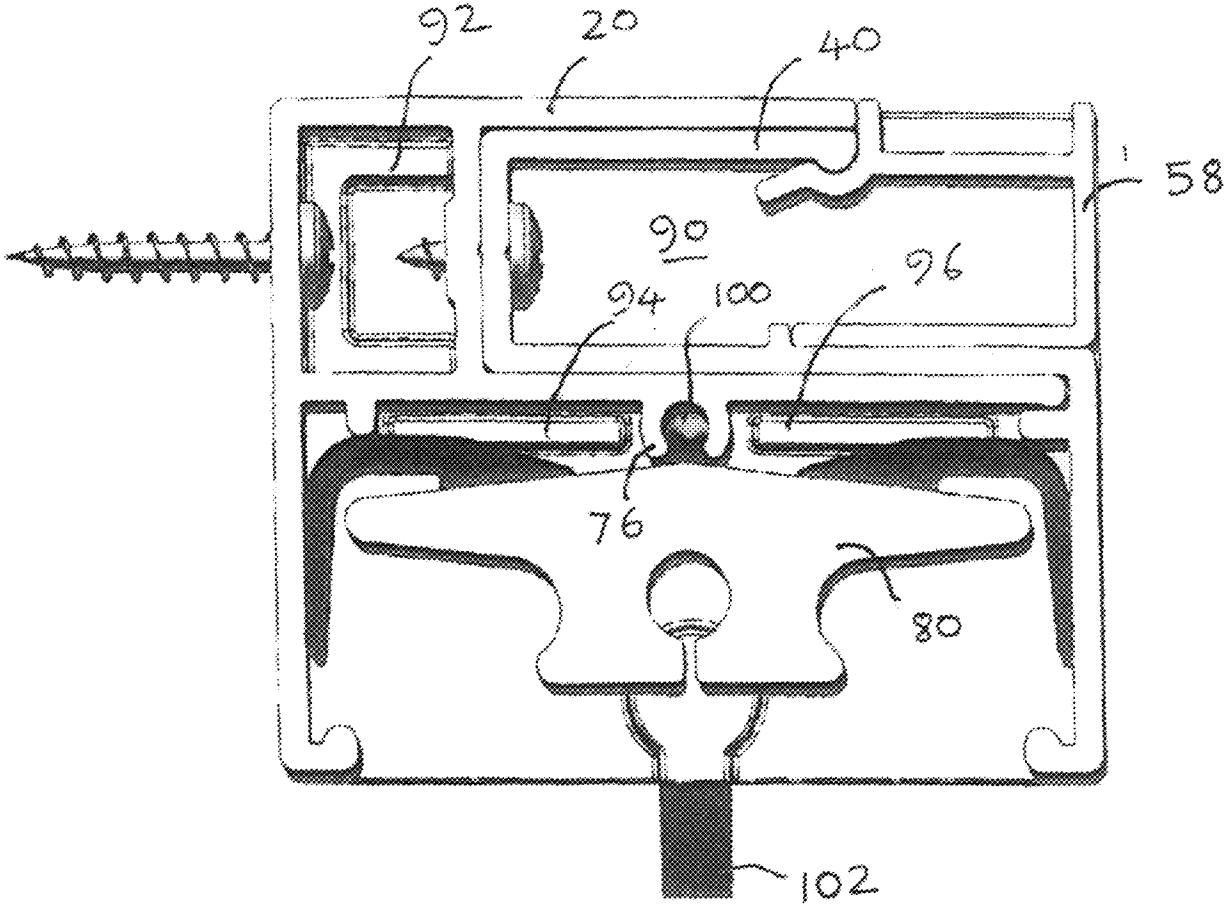
FIG. 6 is another cross sectional view of the guide track assembly as shown in FIG. 1, in which the screen retaining member is in a different position to that shown in FIG. 3.

A disadvantage with prior art horizontally opening screens is that the door lintels or other support to which the guide assembly is attached can sag over time. As the guide assembly is fixed to the door lintel, the guide assembly also drops with the lintel. In the prior art, lintel sag often caused a loss of tension in the screen. However, in the guide assembly 10 as disclosed herein, because of the fact that the screen retaining member is held within the guide channel 11 against the bias of the wings 86, 88 if there is lintel sag and the guide assembly 10 drops, the bias of the screen retaining member 80 can compensate for the drop so as to reduce or minimise loss in tension of the screen. FIG. 6 shows the screen retaining member 80 in such a compensating position.

The guide track assembly 10 and installation of the guide track assembly 10 will now be described.

Figure 2:
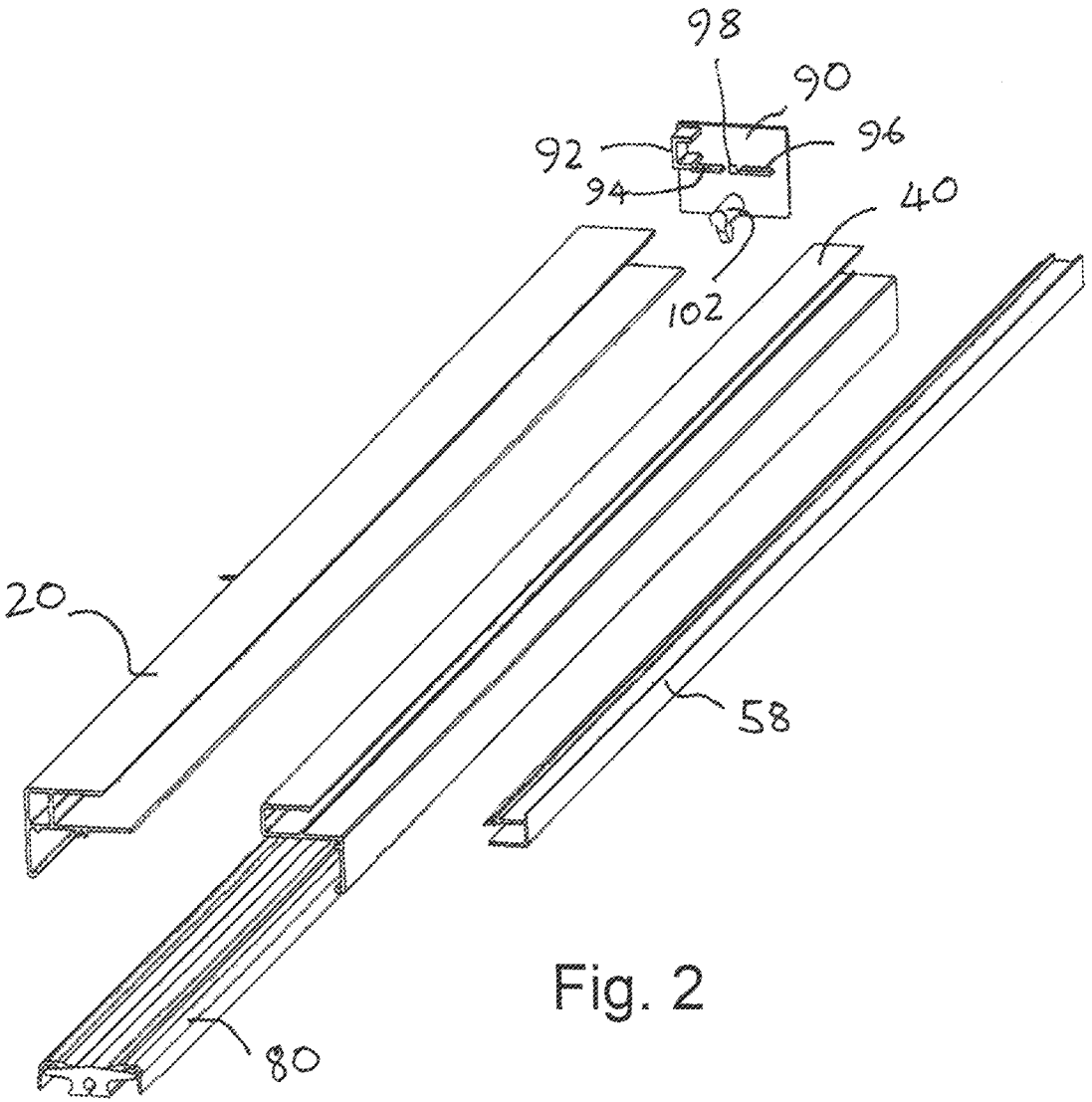
FIG. 2 is an exploded perspective view of the guide track assembly shown in FIG. 1.
Figure 7:
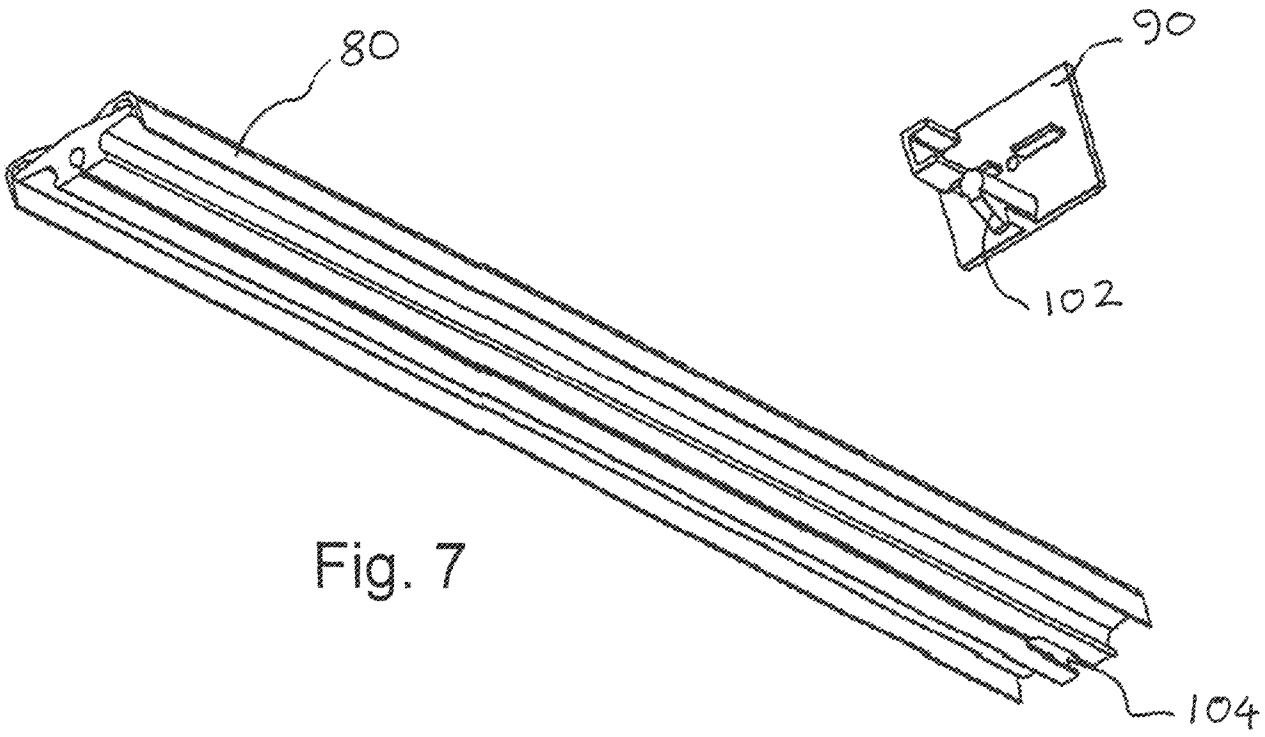
FIG. 7 is a bottom perspective view of the screen retaining member and end cap of the guide track assembly shown in FIG. 1.

The guide track assembly 10 further includes an end cap 90 (see FIGS. 2 and 7). The end cap 90 has a U shaped projection 92 that is dimensioned to be snugly received within rectangular section 26 of the attachment member 20. This allows for easy alignment of the attachment member 20 with the cap 90 during installation. The location of projection 92 within the end of section 26 may be seen in FIG. 6. The cap 90 also includes two longitudinal projections 94, 96. These projections 94, 96 are dimensioned and located to be positioned adjacent and below lower horizontal wall 36 of the attachment member 20.

The end cap 90 is fixed to the end of the guide track assembly has an aperture 98 axially located with respect to the projection 98 on the attachment member 20. In use, a screw is passed through aperture 98 so as to engage the attachment member 20. The point of the screw 100 is shown in FIG. 6.

The cap 90 further includes a rounded projection 102 terminating in a rearwardly inclined stop. This projection 102 cooperates with slot 104 of the screen retaining member at the end of the screen retaining channel 84. In use, projection 102 acts as a stop for the thickened upper edge of a screen when the screen is being pushed towards the open position.

Prior to installation, the elongate track attachment member 20 and elongate track outer member 40 are loosely connected together with screw 56 such that the opening of the guide channel 11 is wider than the width w1 of the body 82 of the extrusion, but narrower than the distance dl between the distal ends 86*a*, 88*a* of the wings in their extended unbiased position (shown in FIG. 5). This loose connection is shown schematically in FIG. 8. This loose connection allows the screen retaining member 80 to be easily pushed into the guide channel against the bias of the wings 86, 88. In some applications, the length of the guide track assembly 10 may be 4 to 6 m. It will be appreciated that this allows for relatively easy placement of the screen retaining member 80 within guide channel 11.

Figure 8:
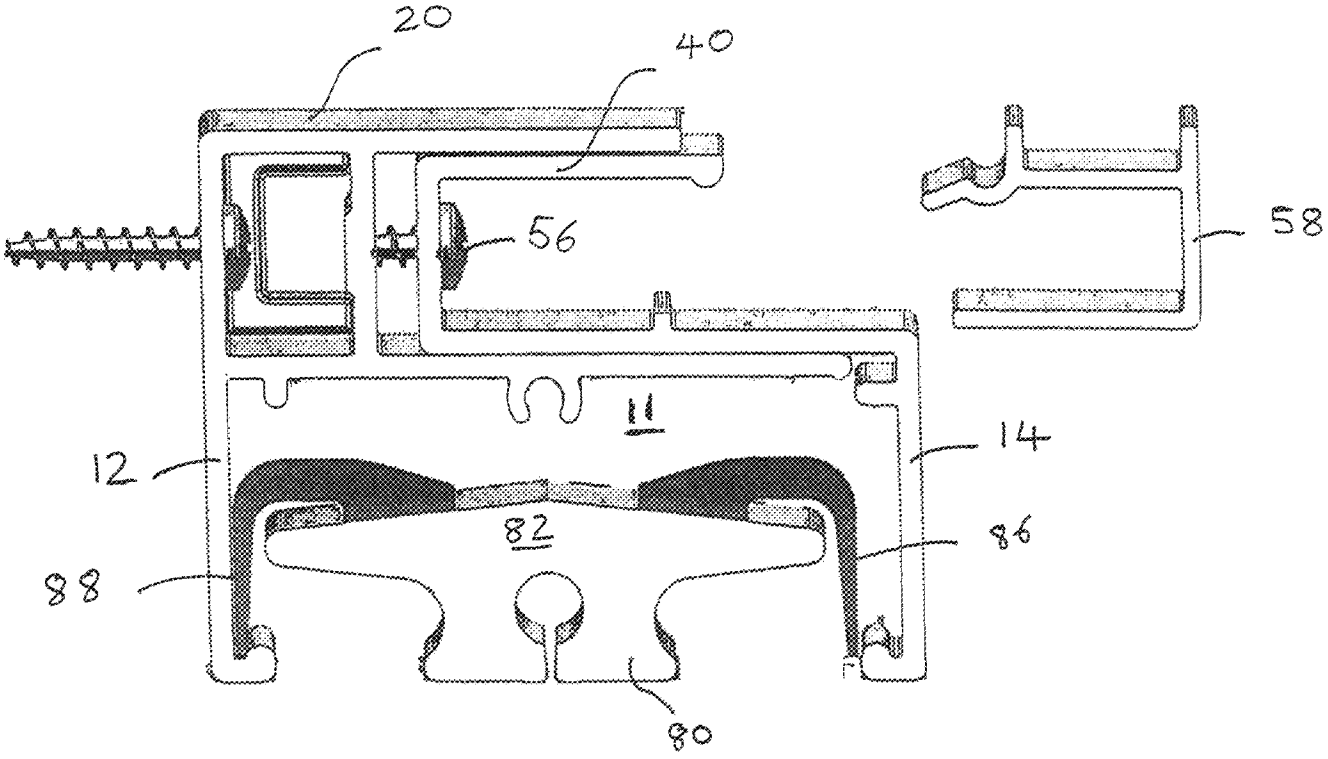
FIG. 8 is a schematic view of the guide track assembly as shown in FIG. 1 in the loosely connected position.

The screws 34 are then tightened so as to draw the two sides 12, 14 of the guide channel 11 towards each other to the positioned in FIG. 3, against the bias of the wings 86, 88 to the in use position. With reference to FIG. 8, it will be understood that as the screws 34 are tightened, the base 50 of the track outer member 40 rides along the lower horizontal wall 36 of the attachment member 20.

The track cover 58 is then clipped into place along the outer side of the assembly so as to provide a neat and tidy appearance to the guide track assembly 10 as a whole. The concavity 68 is complementary to the thickened edge 49 of the upper wall 48 of the track outer member 40 so as to facilitate a snap fit between the track cover 58 and track outer member 40 for ease of assembly.

Figure 9:
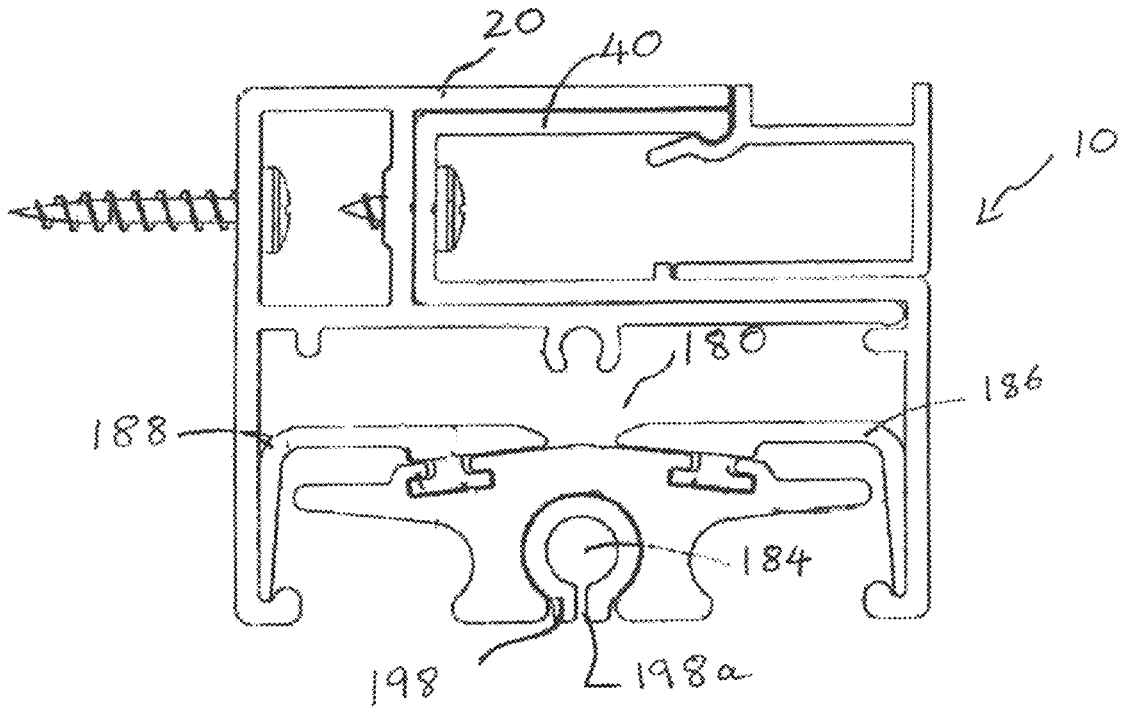
FIG. 9 is a cross section of the guide track assembly as shown in FIG. 3, but with a different screen retaining member.
Figure 10:
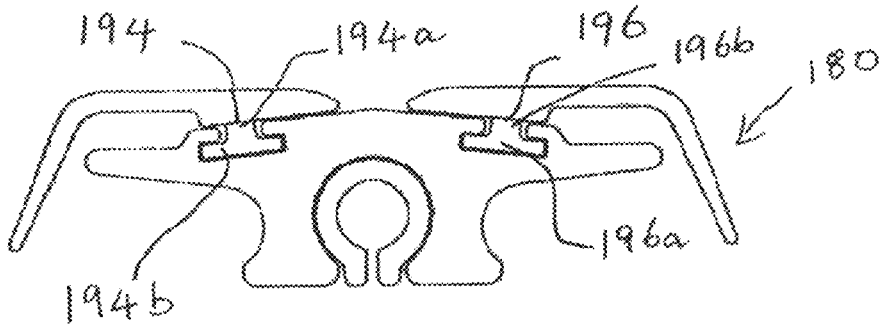
FIG. 10 is a cross section of the screen retaining member of the guide track assembly shown in FIG. 9 in its extended open position.
Figure 11:
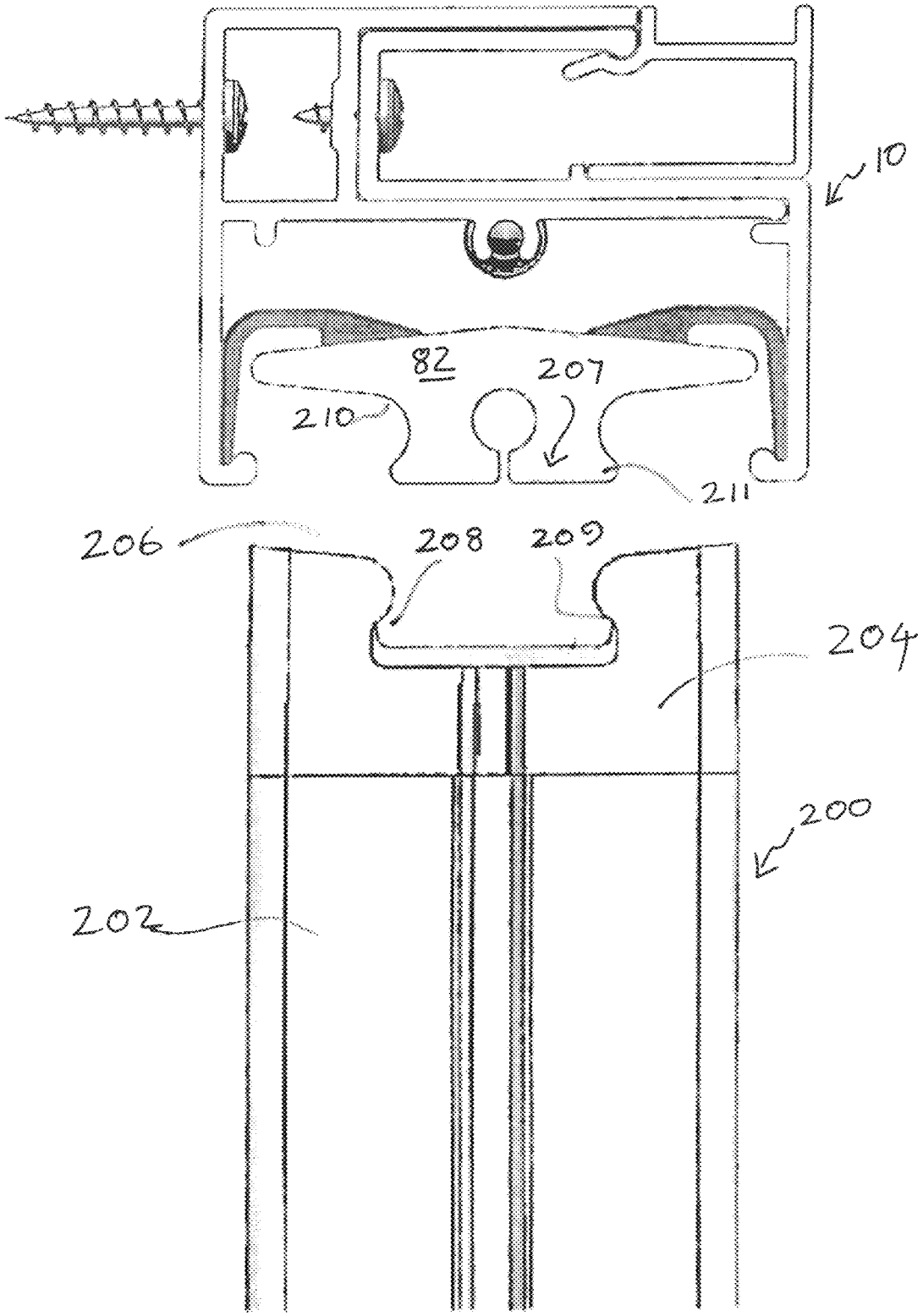
FIG. 11 is a schematic view showing the guide track assembly as shown in FIG. 1 with a drawbar of a screen assembly.

FIGS. 9 to 11 show the guide track assembly 10 with an alternative screen retaining member 180. The other components of the guide track assembly are as previously described and the same reference numerals will be used to refer to the same parts.

Figure 10A:
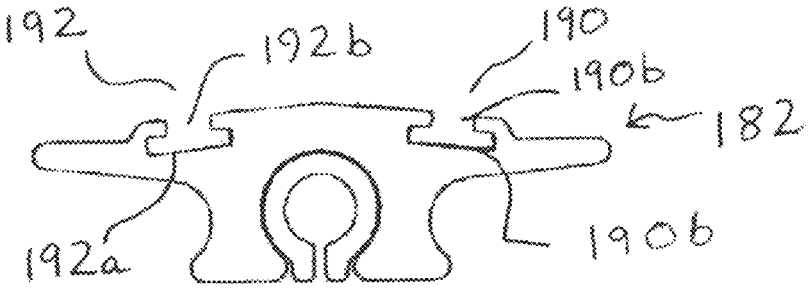
FIG. 10*a* is a cross section of the body of the screen retaining member as shown in FIG. 10.

FIG. 10 shows the screen retaining member 180 in which the wings 186, 188 are in the extended position. FIG. 10*a* shows the body 182 of the screen retaining member.

The screen retaining member 180 has essentially the same overall shape as the screen retaining member 80 as shown in FIG. 1 in that the screen retaining member 180 has a body 182 and two wings 186, 188 extending from the body 182.

The body 182 is an aluminium extrusion. The upper section of the body 182 has two longitudinal recesses 190, 192 extending along the length thereof. The recesses 190, 192 have a wide base 190*a*, 192*a* and a narrower retaining collar 190*b*, 192*b*.

The proximal end of each wing 186, 188 has a projection 194, 196, that is complementary to the respective recess 190, 192 in the body. Each projection 194, 196 has a wide retaining member 194*a*, 194*b* and a narrower neck 194*b*, 196*a*. This arrangement allows the body 180 to slidingly receive the projections 194, 196 of the wings and to be retained thereby.

The projections 194, 196 are formed from a substantially rigid thermoplastic such as PVC. The main body of each wing is formed from an extruded thermoplastics elastomer such that they are more resilient and flexible than the projections 194, 196. The wings 186, 188 are suitably co-extruded.

The upper guide track assembly 10 as shown in FIGS. 9 and 10 also includes a substantially circular liner 198 located within retaining channel 184. In use the thickened edge of a screen member will be retained within the retaining channel 84 and will be supported by liner 198.

The liner 198 is suitably a rigid extruded thermoplastics elastomeric material such as PVC. The liner 198 fits snugly within channel 84 but is free to move with respect to the retainer body 182 so as to absorb a rotational force as a result of the screen being subjected to wind or being struck by an object. In the event of an impact upon a screen held within the channel, a downward force will be applied to the liner 198 so that it may pinch down upon the thickened edge of the screen which helps to resist the screen from being pulled out of the channel 184.

In the event of a sideways force on the screen, such as being blown by a strong wind, or hit by an object, the liner 198 can rotate within channel 184 so as to reduce resistance on the thickened edge of the screen.

This may be compared with the body 82 of the screen retaining member 80 as shown in FIG. 1 that is a single piece of PVC. When this screen retaining member 80 is subjected to excess stress, the PVC body 82 also accommodates the pressure. However, if the excess pressure is too great, the side walls of the narrow section 84*a* can distort and the screen can be pulled out of channel 84. However, where the body 182 of the screen retaining member 180 is made from a rigid material such as aluminium, the side walls of narrow section 198*a* of the liner 198 are held or pinched together against the rigid aluminium, such that there is less chance of the screen being pulled out of the screen retaining member 180.

As the body 82 of the screen retaining member 80 as shown in FIG. 1 is in one piece, there is also no ability to absorb or accommodate a rotational force on the upper edge of the screen as described above in which the liner 198 can rotate within channel 184.

Figure 12:
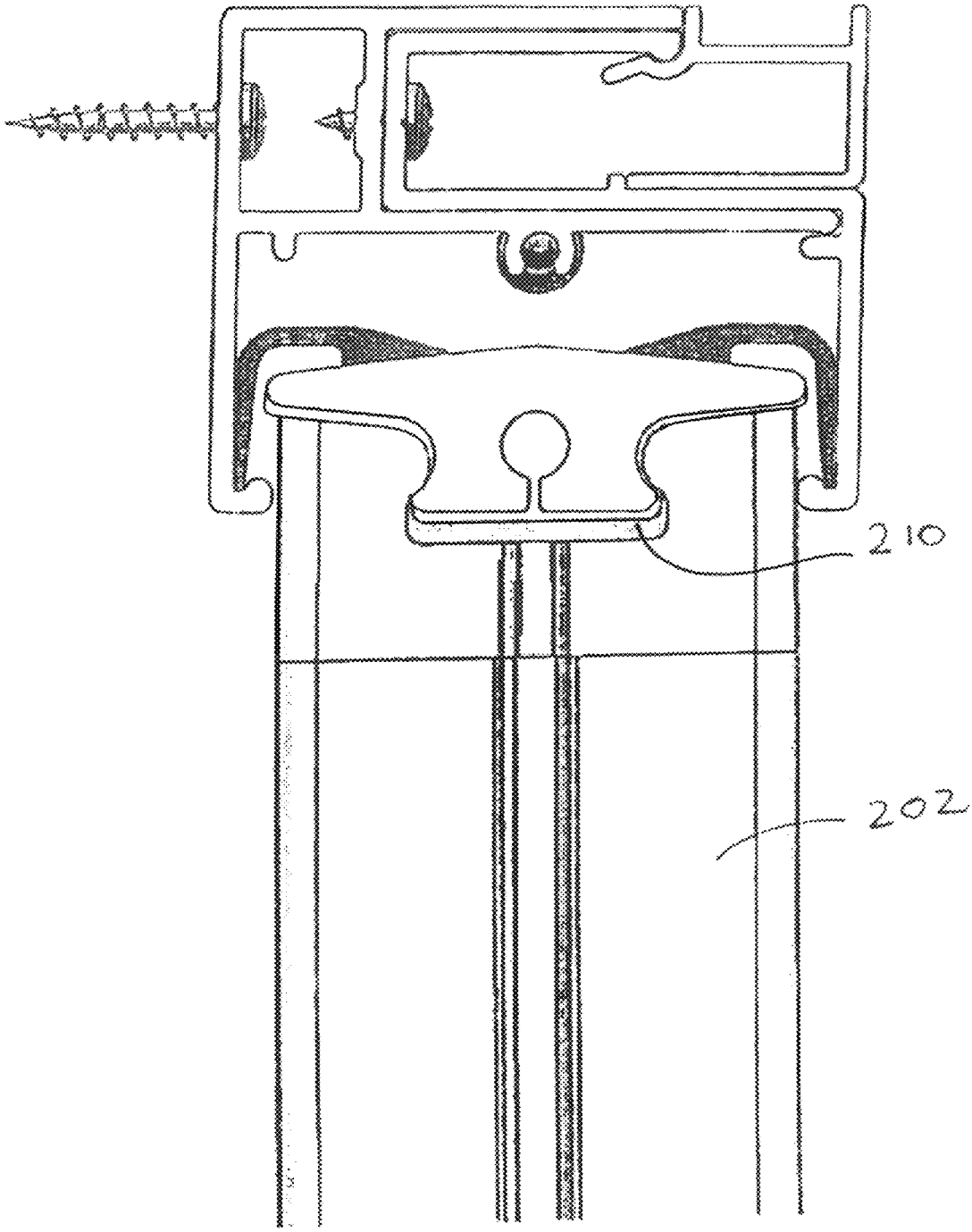
FIG. 12 shows the guide track assembly and drawbar as shown in FIG. 11 in an engaged position.

FIGS. 11 and 12 show how the upper guide track assembly 10 as shown in FIG. 1 engages with a drawbar 200 so as to guide the upper part of the drawbar 200 between an open position towards a roller and a closed position away from the roller. The drawbar 200 retains a free edge of a screen. FIG. 11 shows the drawbar 200 spaced from the upper guide track assembly 10.

The drawbar 200 has a main body 202 and an end cap 204. The upper facing part 206 of the end cap 204 has a profile that is complementary to the lower part 207 of the screen retaining member body 82. Specifically, the upper profile of the cap 204 is substantially U shaped, the inner walls of the U defined by longitudinal inwardly facing curved ribs 208, 209.

The lower part 207 of the screen retaining member body 80 has curved channels 210, 211 extending along both sides thereof.

It will be appreciated that various changes and modifications may be made to the invention as disclosed and claimed herein without departing from the spirit and scope thereof.

The invention claimed is:

1. An upper guide track assembly for a horizontally opening retractable screen that in use is attached to a support and has an inner side facing towards the support and an outer side facing outwards away from the support; the upper guide track assembly comprising;

a U shaped guide channel having an inner side wall, an outer side wall, an upper wall, and a width between the inner side wall and the outer side wall;

an elongate track attachment member for attaching the upper guide track assembly to the support, the elongate track attachment member having a wall section forming the inner side wall of the guide channel, an upper attachment section that is configured to receive a fastener to fasten the guide track assembly to a support and a lower wall section that forms the inner side wall of the guide channel, an inner channel of rectangular cross section having a wall that is contiguous with the lower wall section and which in use receives a fastener for fastening the attachment member to the support;

an elongate track outer member connectable to the attachment member having a wall section forming the outer side wall of the guide channel; and an elongate screen retaining member within the guide channel, wherein the elongate screen retaining member comprises;

an elongate body having a lower face with a longitudinal channel for receiving and retaining an upper edge of a retractable screen;

a first resilient wing and a second resilient wing extending from respective first and second sides of the elongate body and each first and second wing comprises a proximal end towards the elongate body and a distal end, and each wing is biased towards an open position in which the distal end of each wing is away from the body and is moveable against the bias to a retracted position in which each distal end of each first and second wing is towards the body; and when the screen retaining member is retained in the guide channel, each first and second wing is held in the retracted position against the bias by contact with respective first and second side walls of the guide channel, such that an upper edge of a retractable screen retained by the screen retaining member is biased in a vertical direction away from a centre part of the retractable screen and the body of the screen retaining member is spaced from the upper wall of the guide channel.

2. The guide track assembly of claim 1, wherein the elongate track attachment member includes a lower horizontal wall section that in use forms the upper wall of the U shaped guide channel.

3. The guide track assembly of claim 1, wherein the upper attachment section includes a channel of U shaped cross section having an end wall and an opposed opening facing towards the outer side of the guide track assembly.

4. The guide track assembly of claim 3, wherein the outer track member includes a channel of U shaped cross section, having an end wall and an opposed opening that is also outwardly facing towards the outer side of the guide track assembly and which is complementary in shape to the channel of U shaped cross section of the upper attachment section such that in use the channel of U shaped section of the upper attachment section is at least partially received within the channel of U shaped channel of the outer track member.

5. The guide track assembly of claim 4, wherein the end wall of the channel of U shaped cross section of the upper attachment section and the end wall of the channel of U shaped cross section of the outer track member abut such that the abutting walls may be fixed together by a fastener.

6. The guide track assembly of claim 4 that further comprises an elongate cover member that can cover the opening of the channel of U shaped section of the elongate track outer member.

7. The guide track assembly of claim 1, wherein each of the inner side wall and outer side wall of the substantially U shaped guide channel comprising an inwardly facing rib that provides a stop for the distal end of each wing of the elongate screen retaining member to hold the screen retaining member within the guide channel.

8. The guide track assembly of claim 1, wherein the body of the elongate screen retaining member is formed from a substantially rigid thermoplastic and each first and second wing is formed form a resilient thermoplastic elastomer and the elongate screen retaining member is formed by co-extrusion.

9. A method of assembling the guide track assembly of claim 1, the method comprising connecting the elongate track attachment member and the elongate track outer member so as to form the U shaped guide channel, wherein the first side wall and the second side wall of the guide channel are spaced apart such that the width of the U shaped guide channel is wider than the width of the body of the screen retaining member but less than the distance between the distal ends of the wings when in the open position; such that the distal end of each wing bears against a respective guide channel side wall and tightening the connection between the upper elongate track attachment member and the elongate track attachment member so as to draw the guide channel side walls together, thereby moving the wings of the screen retaining member to the retracted position.

10. A screen having an upper guide track and a lower guide track, a roller assembly and a flexible screen, wherein the upper guide track is the upper guide track assembly of claim 1.

11. The screen of claim 10, wherein the screen comprises a drawbar that is operatively engaged with the upper guide track assembly for movement between open and closed positions, wherein the body of the elongate screen retaining member has a lower part having a first profile and the draw bar has an upper part with a second profile, the first profile is complementary to the second profile such that the lower part of the elongate screen retaining member guides the upper part of the drawbar.

12. The screen of claim 11, wherein the flexible screen has an upper zipper edge.

13. An upper guide track assembly for a horizontally opening retractable screen that in use is attached to a support and has an inner side facing towards the support and an outer side facing outwards away from the support; the upper guide track assembly comprising;

a U shaped guide channel having an inner side wall, an outer side wall and an upper wall;

an elongate track attachment member for attaching the upper guide track assembly to the support, the elongate attachment member having a wall section forming the inner side wall of the guide channel;

an elongate track outer member connectable to the attachment member having a wall section forming the outer side wall of the guide channel; and an elongate screen retaining member within the guide channel, wherein the elongate screen retaining member comprises;

an elongate body having a lower face with a longitudinal channel for receiving and retaining an upper edge of a retractable screen;

a first resilient wing and a second resilient wing extending from respective first and second sides of the elongate body and each first and second wing comprises a proximal end towards the elongate body and a distal end, and each wing is biased towards an open position in which the distal end of each wing is away from the body and is moveable against the bias to a retracted position in which each distal end of each first and second wing is towards the body;

wherein the body of the elongate screen retaining member is formed separately from each first and second wing and the body of the elongate screen retaining member and each wing are joined together and when the screen retaining member is retained in the guide channel, each first and second wing is held in the closed position against the bias by contact with respective first and second side walls of the guide channel, such that an upper edge of a retractable screen retained by the screen retaining member is biased in a vertical direction and the body of the screen retaining member is spaced from the upper wall of the guide channel.

14. The guide track assembly of claim 13, wherein the elongate screen retaining member body is an aluminum extrusion.

15. The guide track assembly of claim 14, wherein each first and second wing comprises a longitudinal recess or projection at the proximal end thereof and the elongate body of the screen retaining member comprises the other of a longitudinal projection or recess for sliding engagement of the proximal end of each first and second wing between the elongate body of the screen retaining member and each first and second wing.

16. The guide track assembly of claim 15, wherein each first and second wing comprises a longitudinal projection at the proximal end thereof, and each projection of each wing is formed from a material that is more rigid than the other part of each first and second wing.

17. The guide track assembly of claim 15, wherein each first and second wing is co-extruded with the projections extruded from a rigid thermoplastic such as a rigid PVC, and the other part of each first and second wing is extruded from a thermoplastic elastomer.

18. The guide track assembly of claim 13, which further comprises an elongate liner within the longitudinal channel in the body of the elongate screen retaining member.

* * * * *